US008471806B2

(12) United States Patent
Shimizu et al.

(10) Patent No.: US 8,471,806 B2
(45) Date of Patent: Jun. 25, 2013

(54) DISPLAY PANEL DRIVE CIRCUIT AND DISPLAY

(75) Inventors: Shinsaku Shimizu, Nara (JP); Tamotsu Sakai, Ikoma (JP); Ichiro Shiraki, Matsusaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 1208 days.

(21) Appl. No.: 12/227,491

(22) PCT Filed: Mar. 20, 2007

(86) PCT No.: PCT/JP2007/055647

§ 371 (c)(1),
(2), (4) Date: Jan. 5, 2009

(87) PCT Pub. No.: WO2007/135805

PCT Pub. Date: Nov. 29, 2007

(65) Prior Publication Data

US 2009/0207320 A1 Aug. 20, 2009

(30) Foreign Application Priority Data

May 24, 2006 (JP) ..... 2006-144713

(51) Int. Cl.
*G09G 3/36* (2006.01)

(52) U.S. Cl.
USPC ..... 345/100; 345/87; 345/89; 345/98; 345/204

(58) Field of Classification Search
USPC ..... 345/37, 41, 42, 60–72, 87–100, 204, 345/690; 315/169.1–169.4
See application file for complete search history.

(56) References Cited

U.S. PATENT DOCUMENTS

| | | | | |
|---|---|---|---|---|
| 5,682,175 | A * | 10/1997 | Kitamura | 345/98 |
| 6,097,362 | A | 8/2000 | Kim | |
| 6,225,866 | B1 * | 5/2001 | Kubota et al. | 330/295 |
| 6,268,841 | B1 | 7/2001 | Cairus et al. | |
| 7,301,520 | B2 * | 11/2007 | Koyama et al. | 345/98 |
| 2002/0167504 | A1 * | 11/2002 | Matsumoto | 345/204 |
| 2003/0011581 | A1 | 1/2003 | Tanaka et al. | |
| 2007/0046612 | A1 * | 3/2007 | Okumura et al. | 345/98 |
| 2009/0289886 | A1 | 11/2009 | Sakai et al. | |

FOREIGN PATENT DOCUMENTS

| | | |
|---|---|---|
| EP | 0606785 | 7/1994 |
| EP | 0929064 | 7/1999 |

(Continued)

OTHER PUBLICATIONS

Search Report of Jul. 2, 2009 by European Patent Office for counterpart European Application No. 07739090.4

*Primary Examiner* — Quan-Zhen Wang
*Assistant Examiner* — Jennifer Nguyen
(74) *Attorney, Agent, or Firm* — Harness, Dickey & Pierce, P.L.C.

(57) ABSTRACT

In one embodiment of the present invention, a display panel drive circuit includes a plurality of circuit blocks each of which includes former circuits and latter circuits. In each of the circuit blocks in the display panel drive circuit, a signal is transmitted from the former circuits to the latter circuits. Further, the display panel drive circuit includes an inter-block shared wire which allows respective two of the circuit blocks adjacent to each other to be connected to each other. Furthermore, in the display panel drive circuit, the signal of the respective two of the circuit blocks adjacent to each other is transmitted in a time division manner, via the inter-block shared wire. This eliminates the need for an external memory or an arithmetic circuit, thereby making it possible to reduce the area of a circuit in a driver.

10 Claims, 10 Drawing Sheets

FOREIGN PATENT DOCUMENTS

| | | |
|---|---|---|
| EP | 0994458 | 4/2000 |
| JP | 06-214531 | 8/1994 |
| JP | 11-175042 | 7/1999 |
| JP | 11-202290 | 7/1999 |
| JP | 11-259036 | 9/1999 |
| JP | 2003-058133 | 2/2003 |
| JP | 2003-131625 | 5/2003 |
| WO | WO 2007/135792 | 11/2007 |

* cited by examiner

DISPLAY PANEL DRIVE CIRCUIT AND DISPLAY

TECHNICAL FIELD

The present invention relates to a source driver (particularly, a digital driver) which is provided in a display device.

BACKGROUND ART

Patent Document 1 discloses one example of the arrangement of a digital driver which is used in a display device. FIG. 9 illustrates the arrangement. The digital driver illustrated in FIG. 9 includes, for each data signal line (S1, . . . ) of a display panel, a circuit block including a plurality of first (1st) latch circuits LAT1 and a plurality of second (2nd) latch circuits LAT2.

In this arrangement, each of the circuit blocks acquires, from D0 through D2, 3-bit data to be supplied to one corresponding data signal line, in response to a pulse signal (1st latch pulse signal) transmitted from a corresponding DEF in a shift register. Then, each of the circuit blocks carries out DA conversion on the 3-bit data in response to a pulse signal (2nd latch pulse signal) transmitted from an LP line, and outputs, to a corresponding one of the data signal lines (S1, S2, . . . ), an analog signal potential thus obtained.

Also, Patent Document 1 discloses another example of the arrangement of a digital driver. FIG. 10 illustrates the arrangement. A digital driver illustrated in FIG. 10 includes, for each group of four digital signal lines (S1 to S4, S5 to S8, . . . ) of a display panel, a circuit block including a plurality of first (1st) latch circuits LAT1 and a plurality of second (2nd) latch circuits LAT2.

In this arrangement, one horizontal period (a period constituted by the first period to the fourth period) is divided into four, and one circuit block is shared with the four data signal lines.

In the first period, each of the circuit blocks acquires, from D0 through D2, 3-bit data to be supplied to a corresponding one of the data signal line (S1, S5, . . . ), in response to a pulse signal (1st latch pulse signal) transmitted from a corresponding DEF in a shift register. Then, each of the circuit blocks carries out DA conversion on the 3-bit data in response to a pulse signal (2nd latch pulse signal) transmitted from an LPa line or an LPb line, and outputs, to a corresponding one of the data signal lines (S1, S5, . . . ), an analog signal potential thus obtained. In the second period which starts subsequently, each of the circuit blocks acquires, from D0 through D2, 3-bit data to be supplied to a corresponding one of the data signal lines (S2, S3, . . . ), in response to a pulse signal (1st latch pulse signal) transmitted from the corresponding DEF in the shift register. Then, each of the circuit blocks carries out DA conversion on the 3-bit data in response to a pulse signal (2nd latch pulse signal) transmitted from the LPa line or the LPb line, and outputs, to a corresponding one of the data signal lines (S2, S6, . . . ), an analog signal potential thus obtained. In the third period and the fourth period, this process is carried out in a similar manner.

[Patent Document 1]

Japanese Unexamined Patent Application Publication, Tokukai, No. 2003-58133 (published on Feb. 28, 2003)

DISCLOSURE OF INVENTION

The arrangement illustrated in FIG. 9, however, has a problem as follows. The arrangement illustrated in FIG. 9 requires (i) 1st latch circuits (LAT1) whose number is equal to the number obtained by multiplying the number of data signal lines (the number of circuit blocks) by the number of bits of data and (ii) 2nd latch circuits (LAT2) whose number is equal to the number of 1st latch circuits. This increases the number of wires connecting between 1st latch circuits and corresponding 2nd latch circuits, thereby increasing the size of a driver. Especially in a case where a driver and a display panel are formed monolithically, the increase in the number of wires significantly affects the size of the driver because the number of layers of wire is limited.

Also, in the arrangement illustrated in FIG. 10, although the number of circuit blocks can be reduced, it is necessary to sort data so as to divide one horizontal period into four. This causes such a problem that a driver requires an external memory and an arithmetic circuit for carrying out such a process.

The present invention was made in view of the foregoing problems, and an object of the present invention is to reduce the size of a driver without need for an external memory or an arithmetic circuit.

A display panel drive circuit according to the present invention includes: a plurality of circuit blocks each of which includes a former circuit and a latter circuit by which the former circuit is followed, and in each of which circuit blocks a signal is transmitted from the former circuit to the latter circuit; and inter-block shared wires which allow respective two of the circuit blocks adjacent to each other to be connected to each other, the signal of the respective two of the circuit blocks being transmitted in a time division manner, via a corresponding one of the inter-block shared wires.

In this arrangement, two circuit blocks adjacent to each other transmit the signal via the single inter-block shared wire in the time division manner. Sharing, with the circuit blocks, the wire to be used for transmitting a signal can reduce the number of wires. This makes it possible to reduce the size of the display panel drive circuit. Especially in a case where the display panel drive circuit is formed on a display panel monolithically, the decrease in the number of wires largely contributes to reduction of the size.

The display panel drive circuit may have such an arrangement that: the signal includes a plurality of video signals; the former circuit includes former signal circuits corresponding to the video signals, respectively; the latter circuit includes latter signal circuits corresponding to the video signals, respectively; each of the inter-block shared wires includes discriminatingly-shared wires (signal-by-signal shared wires) for the video signals; and the video signals are inputted to the former signal circuits, and are transmitted to the latter signal circuits via the discriminatingly-shared wires, respectively.

Also, the display panel drive circuit may further include switch circuits provided between (i) the former signal circuits and (ii) the discriminatingly-shared wires, respectively. In this case, the display panel drive circuit may have such an arrangement that the switch circuits, provided between (i) the former signal circuits belonging to odd-numbered ones of the circuit blocks and (ii) the discriminatingly-shared wires, respectively, are connected to a first control signal line; and the switch circuits, provided between (i) the former signal circuits belonging to even-numbered ones of the circuit blocks and (ii) the discriminatingly-shared wires, respectively, are connected to a second control signal line.

Also, the display panel drive circuit may further includes: a signal passing circuit which is provided for each of the circuit blocks; and an inter-signal shared wire which (i) is provided for each of the circuit blocks, and (ii) is connectable to all of the latter signal circuits belonging to said each of the circuit blocks, the signal from each of the latter signal circuits being transmitted to the signal passing circuit in the time division manner, via the inter-signal shared wire. This makes it possible to reduce the number of wires to be used between the latter signal circuits and the signal passing circuit, thereby further reducing the size of the display panel drive circuit. Also, the signal passing circuit may be a digital-analog converter (DAC) circuit. This makes it possible to reduce the number of DAC circuits.

Further, the display panel drive circuit may have such an arrangement that: each of the former signal circuits includes first latch circuits whose number is equal to the number of bits of a corresponding one of the video signals; each of the latter signal circuits includes second latch circuits whose number is equal to the number of bits of a corresponding one of the video signals; and each of the discriminatingly-shared wires includes wires whose number is equal to the number of bits of a corresponding one of the video signals. Also, latch pulse signals, to be supplied to the second latch circuits in the latter signal circuits, are supplied, respectively, via a wire which is not any of the discriminatingly-shared wires. In this case, it is preferable that: the latch pulse signals to be supplied to the second latch circuits in the latter signal circuits belonging to the odd-numbered ones of the circuit blocks are supplied, respectively, via the first control signal line; and the latch pulse signals to be supplied to the second latch circuits in the latter signal circuits belonging to the even-numbered ones of the circuit blocks are supplied, respectively, via the second control signal line.

A display panel drive circuit according to the present invention includes: a plurality of circuit blocks each of which includes a plurality of former signal circuits and latter signal circuits corresponding to the former signal circuits, respectively, and in each of which circuit blocks a signal is transmitted from the former signal circuits to corresponding ones of the latter signal circuits, respectively; and an intra-block shared wire which (i) is provided for each of the circuit blocks, and (ii) is connectable to all of the former signal circuits belonging to said each of the circuit blocks, the signal from each of the former signal circuits being transmitted in a time division manner, via the intra-block shared wire.

As such, transmitting the signal from the former signal circuits to the corresponding ones of the latter signal circuits via the intra-block shared wire in the time division manner reduces the number of wires to be used. This makes it possible to reduce the size of the display panel drive circuit. Especially in a case where a display panel drive circuit is formed on a display panel monolithically, the decrease in the number of wires largely contributes to reduction in the size.

The display panel drive circuit may have such an arrangement that: the signal includes a plurality of video signals; the former signal circuits are provided so as to correspond to the video signals, respectively; the latter signal circuits are provided so as to correspond to the video signals, respectively; and the video signals are inputted to the former signal circuits, and are transmitted to the latter signal circuits, respectively, via the intra-block shared wire.

Also, the display panel drive circuit may include switch circuits provided between the intra-block shared wire and the former signal circuits, respectively.

Further, the display panel drive circuit may have such an arrangement that: each of the former signal circuits includes first latch circuits whose number is equal to the number of bits of a corresponding one of the video signals; each of the latter signal circuits includes second latch circuits whose number is equal to the number of bits of a corresponding one of the video signals; and the intra-block shared wire includes wires whose number is equal to the number of bits of a corresponding one of the video signals. Also, latch pulse signals, to be supplied to the second latch circuits in the latter signal circuits, are supplied, respectively, via a wire which is not the intra-block shared wire. In this case, it is preferable for the display panel drive circuit to include control signal lines whose number is equal to the number of the video signals, and to have such an arrangement that a single control signal line is used for supplying (a) control signals to the switch circuits of the former signal circuits and (b) the latch pulse signals to the second latch circuits in the latter signal circuits corresponding to the former signal circuits, respectively.

A display device according to the present invention includes: a display panel; and the display panel drive circuit. In this case, the display panel and the display panel drive circuit may be formed monolithically. Examples of the display device may encompass a liquid crystal display device.

Thus, in a display panel drive circuit of the present invention, a signal is transmitted between two circuit blocks adjacent to each other via a single inter-block shared wire. Sharing, with circuit blocks, a wire used for transmitting a signal makes it possible to reduce the number of wires, thereby reducing the size of a display panel drive circuit.

EXPLANATION FOR REFERENCE NUMERALS

Figure 1:
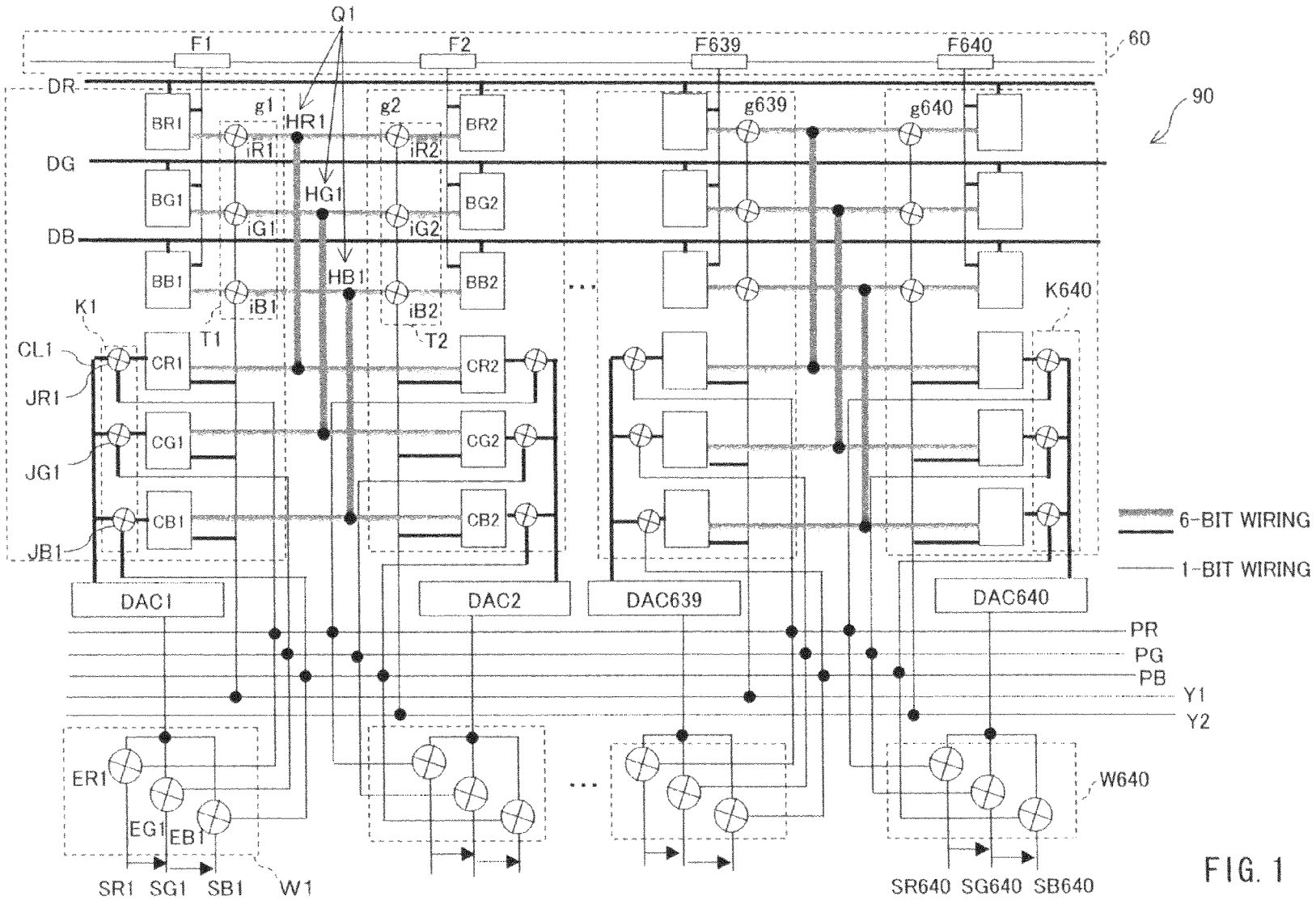
FIG. 1 is a circuit diagram illustrating one arrangement of a digital driver according to the present embodiment.

10: Liquid crystal display device (Display device)
30: Display section
40: Gate driver
90, 95: Source drivers (Display panel drive circuits)
Q: Inter-block shared wire
HR, HG, HB: Discriminatingly-shared wires
CL: Inter-signal shared wire
N: Intra-block shared wire
T: Transmission switch block
iR, iG, iB: Switch circuits (for switching transmission)
MR, MG, MB: Transmission switch lines (Control signal lines)
Y1, Y2: Latch pulse lines (First and second control signal lines)

BEST MODE FOR CARRYING OUT THE INVENTION

One embodiment of the present invention is described below with reference to FIG. 1 through FIG. 8. FIG. 6 is a block diagram illustrating the arrangement of a liquid crystal display device according to the present embodiment. As illustrated in FIG. 6, a liquid crystal display device 10 includes a display section 30, a gate driver 40, and a source driver 90. The display section 30, the gate driver 40, and the source driver 90 are provided on the same substrate, so as to realize a so-called "system on panel". The source driver 90 is supplied with an input signal (video data) and various kinds of control signals. The display section 30 is provided with pixels in the vicinity of intersections at which a plurality of scanning signal lines extending in the row direction (in the horizontal direction) and a plurality of data signal lines extending in the column direction (in the vertical direction) cross.

FIG. 1 is a circuit diagram illustrating the arrangement of a source driver in the liquid crystal display device. The source driver 90 is a digital driver for (i) generating an analog signal potential in accordance with a digital input signal (e.g., 6 bits) inputted from the outside of the panel and (ii) supplying the analog signal potential to the data signal lines of the display section 30.

As illustrated in FIG. 1, the digital driver 90 includes: a plurality of signal processing blocks (not illustrated); three input signal lines DR, DG, and DB; three switch control lines PR, PG, and PB; and two latch pulse lines Y1 and Y2 (the first control signal line and the second control signal line).

Each of the signal processing blocks includes one flip-flop F (in a shift register), one circuit block g, one DAC, and one time division switch block W. Also, each of the signal processing blocks corresponds to three data signal lines SR, SG, and SB of the display section. The time division switch block W includes three analog switches ER, EG, and EB.

The circuit block g includes: a former circuit including three former latch blocks (former signal circuits) BR, BG, and BB lined up in the column direction; a latter circuit including three latter latch blocks (latter signal circuits) CR, CG, and CB lined up in the column direction; one transmission switch block T; one selection switch block K; and one inter-signal shared wire (6 bits) CL. In the digital driver 90, a plurality of circuit blocks are lined up in the row direction. Two circuit blocks adjacent to each other (e.g., the first circuit block and the second circuit block, and the third circuit block and the forth circuit block) have an inter-block shared wire Q between them. Further, the inter-block shared wire Q includes three discriminatingly-shared wires HR, HG, and HB.

The transmission switch block T includes three switch circuits iR, iG, and iB. The switch circuit iR contains 6 switching elements corresponding to HR; the switch circuit iG contains 6 switching elements corresponding to HG; and the switch circuit iB contains 6 switching elements corresponding to HB. (The 6 switching elements represent 6 bits.) That is, the transmission switch block T includes 18 switching elements for representing 18 bits. The selection switch block K includes three switch circuits JR, JG, and JB. The selection switch circuit JR contains 6 switching elements corresponding to the latter latch block CR; the selection switch circuit JG contains 6 switching elements corresponding to the latter latch block CG; and the selection switch circuit JB contains 6 switching elements corresponding to the latter latch block CB. (The 6 switching elements represent 6 bits.) That is, the selection switch block K includes 18 switching elements for representing 18 bits.

For example, the first signal processing block includes a flip flop F1, a circuit block g1, a DAC 1, and a time division switch block W1. The first signal processing block corresponds to three data signal lines SR1, SG1, and SB1. The time division switch block W1 includes three analog switches ER1, EG1, and EB1. The circuit block g1 includes: three former latch blocks BR1, BG1, and BB1; three latter latch blocks CR1, CG1, and CB1; a transmission switch block T1; a selection switch block K1; and an inter-signal shared wire CL1. The transmission switch block T1 includes three switch circuits iR1, iG1, and iB1, and the selection switch block K1 includes three switch circuits JR1, JG1, and JB1. Further, the circuit block g1 and the circuit block g2 adjacent to each other have an inter-block shared wire Q1 between them. The inter-block shared wire Q1 includes discriminatingly-shared wires HR1, HG1, and HB1.

As illustrated in FIG. 1, each of the former latch blocks is connected to a corresponding flip flop and to a corresponding input signal line. Further, each of the former latch blocks is connected to a corresponding latter latch block, via a corresponding switch circuit and a corresponding discriminatingly-shared wire (6 bits). Also, each of the latter latch blocks is connected to a DAC via a corresponding switch circuit and an inter-signal shared wire (6 bits), and is connected to the latch pulse line Y1 or the latch pulse Y2.

For example, the former latch block BR1 is connected to the flip flop F1 and the input signal line DR, and is connected to the latter latch block CR1 via the switch circuit iR1 and the discriminatingly-shared wire HR1 (6 bits). The latter latch block CR1 is connected to the DAC 1 via the switch circuit JR1 and the inter-signal shared wire CL1 (6 bits), and is connected to the latch pulse line Y1. A former latch block BR2 is connected to a flip flop F2 and the input signal line DR, and is connected to a latter latch block CR2 via a switch circuit iR2 and the discriminatingly-shared wire HR1 (6 bits). Further, the latter latch block CR2 is connected to a DAC 2 via a switch circuit JR2 and the inter-signal shared wire CL2 (6 bits), and is connected to the latch pulse line Y2.

Figure 2:
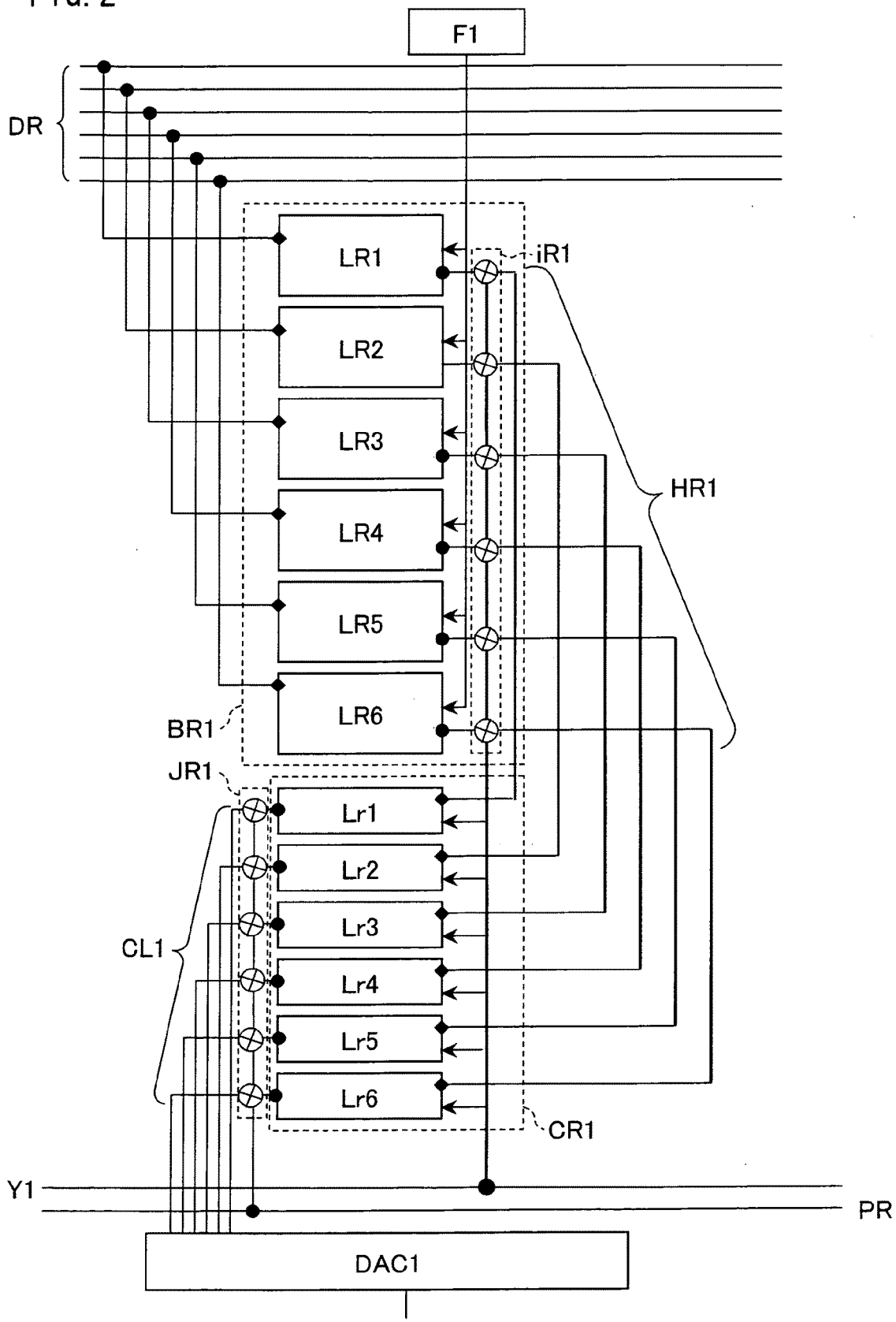
FIG. 2 is a circuit diagram specifically illustrating a part of the arrangement of the digital driver illustrated in FIG. 1.

Each of the former latch blocks includes six 1st (first) latch circuits lined up in the column direction, and each of the latter latch blocks includes six 2nd (second) latch circuits lined up in the column direction. For example, as illustrated in FIG. 2, the former latch block BR1 includes 1st latch circuits LR1 to LR6, and the latter latch block CR1 includes 2nd latch circuits Lr1 to Lr6.

The following describes the connection between the former latch block BR1 and the latter latch block CR1 more specifically. All of the six 1st latch circuits LR1 to LR6 belonging to the former latch block BR1 are connected to the corresponding flip flop F1. Also, the 1st latch circuits LR1 to LR6 are connected to the corresponding wires (1-bit wires) in the input signal line DR (6-bit wire), respectively. Further, the 1st latch circuits LR1 to LR6 are connected to the corresponding 2nd latch circuits in the latter latch block CR1, via the switch circuit iR1 and the corresponding wires in the discriminatingly-shared wire HR1 (6-bit wire), respectively. For example, the 1st latch circuit LR1 is connected to the 2nd latch circuit Lr1, via the switch circuit iR1 and the corresponding wire (1-bit wire) in the discriminatingly-shared wire HR1. Also, the 1st latch circuit LR6 is connected to the 2nd latch circuit Lr6, via the switch circuit iR1 and the corresponding wire (1-bit wire) in the discriminatingly-shared wire HR1. On the other hand, all of the 2nd latch circuits Lr1 to Lr6 are connected to the latch pulse line Y1, and are connected to the DAC 1 via the switch circuit JR1 and the corresponding wires (1-bit wires) in the inter-signal shared wire CL1, respectively. Further, the latch pulse line Y1 is connected to the switch circuit iR1.

Figure 3:
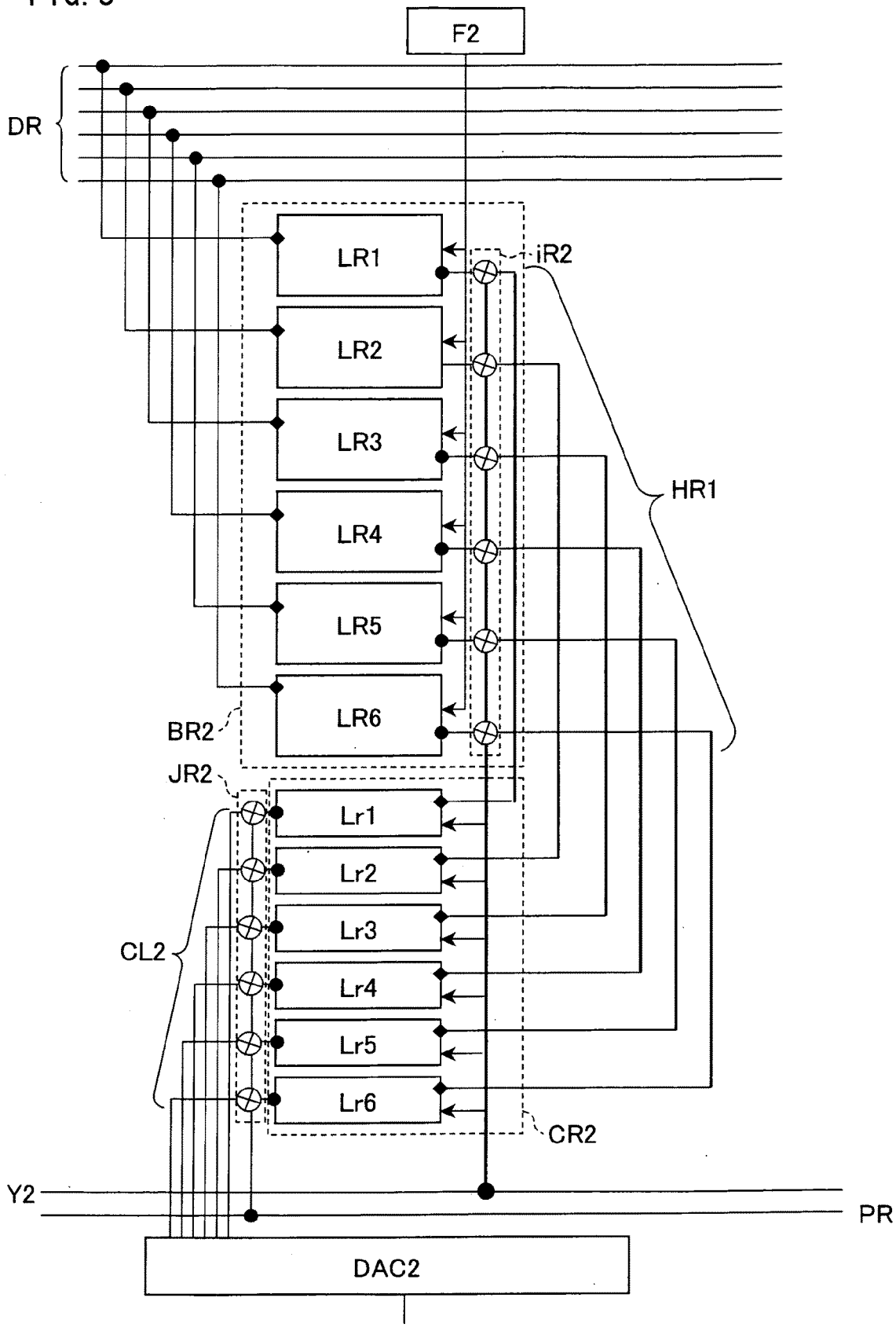
FIG. 3 is a circuit diagram specifically illustrating a part of the arrangement of the digital driver illustrated in FIG. 1.

Further, the following describes, with reference to FIG. 1 and FIG. 3, the connection between the former latch block BR2 and the corresponding latter latch block CR2 more specifically. All of the six 1st latch circuits LR1 to LR6 belonging to the former latch block BR2 are connected to the corresponding flip flop 2 in the shift register. Also, the 1st latch circuits LR1 to LR6 are connected to the corresponding wires (1-bit wires) in the input signal line DR (6-bit wire), respectively. Further, the 1st latch circuits LR1 to LR6 are connected to the corresponding 2nd latch circuits in the latter latch block CR2, via the switch circuit iR2 and the corresponding wires (1-bit wires) in the discriminatingly-shared wire HR1 (6-bit wire), respectively. For example, the 1st latch circuit LR1 is connected to the 2nd latch circuit Lr1, via the switch circuit iR2 and the corresponding wire (1-bit wire) in the discriminatingly-shared wire HR1. Also, the 1st latch circuit LR6 is connected to the 2nd latch circuit Lr6, via the switch circuit iR2 and the corresponding wire (1-bit wire) in the discriminatingly-shared wire HR1. On the other hand, all of the 2nd latch circuits Lr1 to Lr6 are connected to the latch pulse line Y2, and are connected to the DAC 2 via the switch circuit JR2 and the corresponding wires (1-bit wires) in the inter-signal shared wire CL2, respectively. Further, the latch pulse line Y2 is connected to the switch circuit iR2.

Thus, all of latter latch blocks belonging to odd-numbered circuit blocks are connected to the latch pulse line Y1, and all of latter latch blocks belonging to even-numbered circuit blocks are connected to the latch pulse line Y2. Further, transmission switch blocks (including three switch circuits) belonging to the odd-numbered circuit blocks are connected to the latch pulse line Y1, and transmission switch blocks (including three switch circuits) belonging to the even-numbered circuit blocks are connected to the latch pulse line Y2.

With this arrangement, when the latch pulse line Y1 is activated, the transmission switch block belonging to the odd-numbered circuit block turns on. Then, a latch pulse signal is inputted to the latter latch block in the circuit block, and a signal that has been latched by the former latch block in the odd-numbered circuit block is outputted from the latter latch block via the inter-block shared wire. Similarly, when the latch pulse line Y2 is activated, the transmission switch block belonging to the even-numbered circuit block turns on. Then, a latch pulse signal is inputted to the latter latch block in the circuit block, and a signal that has been latched by the former latch block in the even-numbered circuit block is outputted from the latter latch block via the inter-block shared wire.

Also, the three switch circuits (JR, JG, and JB) included in each of the selection switch blocks are connected to the corresponding switch control lines (PR, PG, and PB), respectively. That is, in a case of the selection switch block K1, the switch circuit JR1 is connected to the switch control line PR, the switch circuit JG1 is connected to the switch control line PG, and the switch circuit JB1 is connected to the switch control line PB.

Each of the DACs is connected to the three data signal lines via the corresponding time division switch block W. For example, the DAC 1 is connected to the data signal lines SR1, SG1 and SB1 via the time division switch block W1.

Further, the three analog switches (ER, EG, and EB) included in each of the time division switch blocks W are connected to the corresponding switch control lines (PR, PG, and PB), respectively. Also, the three analog switches (ER, EG, and EB) are connected to the corresponding data signal lines (SR, SG, and SB), respectively.

For example, the analog switch ER1 in the time division switch block W1 is connected to the switch control line PR and to the data signal line SR1, the analog switch EG1 is connected to the switch control line PG and to the data signal line SG1, and the analog switch EB1 is connected to the switch control line PB and to the data signal line SB1.

For example, a red (R) signal is processed by: the former latch block BR connected to the input signal line DR for red; the switch circuit iR; the discriminatingly-shared wire HR; the latter latch block CR1; the switch circuit JR; the DAC; and the analog switch ER. An analog signal thus obtained through the process is outputted to the data signal line SR for red. A green (G) signal and a blue (B) signal are processed in a similar manner. The DAC processes signals of three colors in a time division manner.

Figure 7:
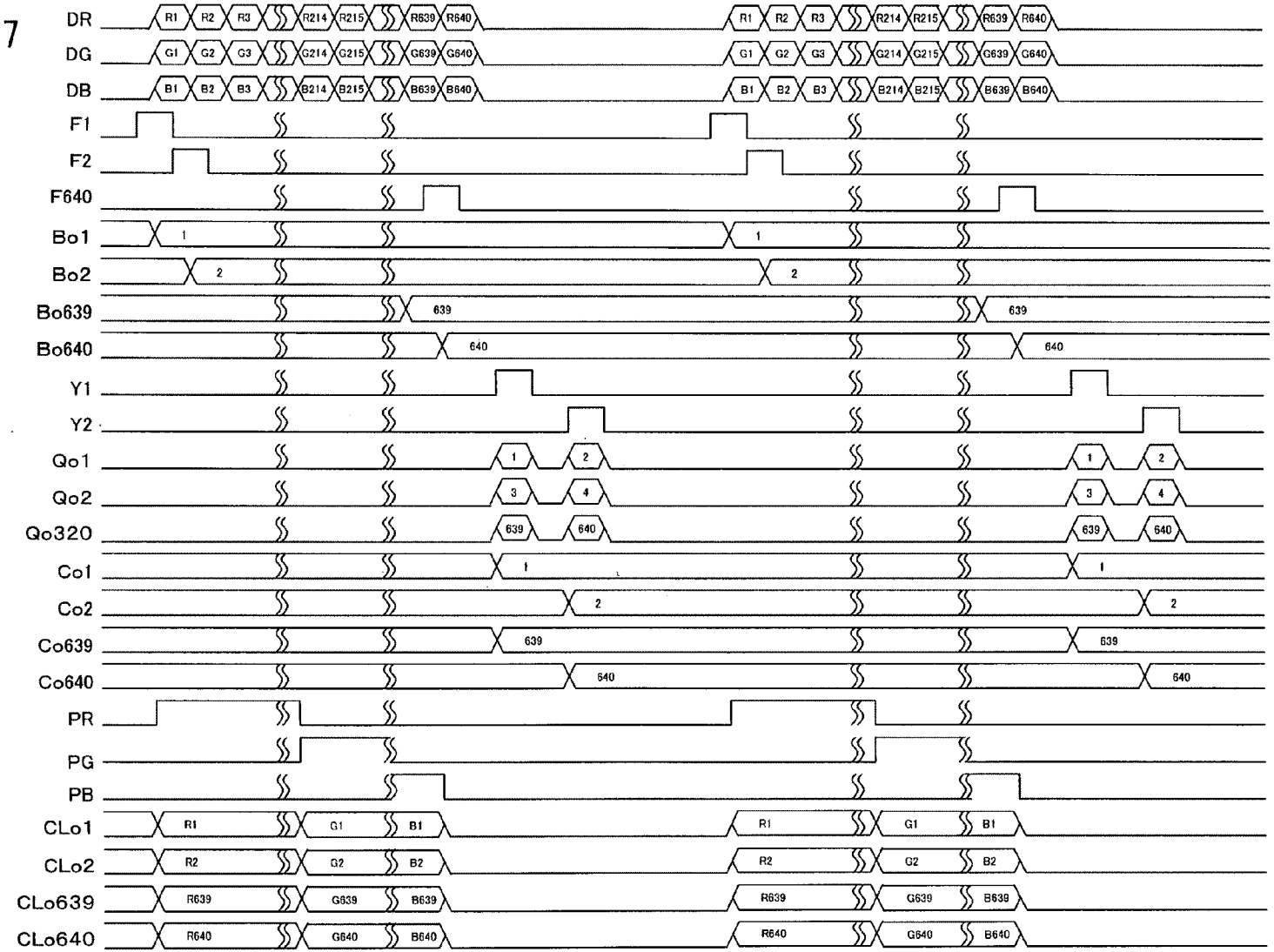
FIG. 7 is a timing chart illustrating operation of the digital driver illustrated in FIG. 1.

The flow of a process how a signal is processed in the digital driver 90 is illustrated in a timing chart in FIG. 7. In this timing chart, R1 to R640 are 6-bit input signal data corresponding to the data signal lines SR1 to SR640, respectively; G1 to G640 are 6-bit input signal data corresponding to the data signal lines SG1 to SG640, respectively; and B1 to B640 are 6-bit input signal data corresponding to the data signal lines SB1 to SB640, respectively. Also, an output signal from the former latch block is Bo, and an output from the latter latch block is Co. Qo1 to Qo320 are signals of the inter-block shared wire; and CLo1 to CLo640 are signals of the inter-signal shared wire.

At the timing when the state of an output pulse signal from F1 changes from "Low" to "High" (active), the former latch block BR1 latches the input signal R1; the former latch block BG1 latches the input signal G1; and the former latch block BB1 latches the input signal B1. Similarly, when the states of output pulse signals from F2, . . . , F640 change from "Low" to "High" one after another, the input signals (R2, G2, and B2), . . . , (R640, G640, and B640) are latched accordingly.

After the input signals (R1, G1, and B1), . . . , (R640, G640, and B640) are all latched, an output pulse signal from the latch pulse line Y1 becomes "High". This turns on all of the transmission switch blocks connected to Y1 (i.e., the transmission switch blocks belonging to the odd-numbered circuit blocks). Then, all of the input signals (R1, G1, and B1), . . . , (R639, G639, and B639) which have been latched by the former latch blocks in the odd-numbered circuit blocks are outputted to the corresponding latter latch blocks via the corresponding inter-block shared wires Q (HR, HG, and HB), respectively. Subsequently, an output pulse signal from the latch pulse line Y2 becomes "High". This turns on all of the transmission switch blocks connected to Y2 (i.e., the transmission switch blocks belonging to the even-numbered circuit blocks). Then, all of the input signals (R2, G2, and B2), . . . , (R640, G640, and B640) which have been latched by the former latch blocks in the even-numbered circuit blocks are outputted to the corresponding latter latch blocks via the corresponding inter-block shared wires Q (HR, HG, and HB), respectively.

Subsequently, at the timing when the state of an output pulse signal from the switch control line PR becomes "High", all of the switch circuits (JR1, . . . ) connected to the switch control line PR turn on simultaneously, and the input signals (R1, . . . ) are inputted to the corresponding DACs (1, . . . ) via the corresponding inter-signal shared wires (CL1, . . . ), respectively. This converts the input signals (R1, . . . , R640) into analog signal potentials (Ra1, . . . , Ra640), respectively. Note that the switch control line PR is also connected to the corresponding analog switch. Therefore, at the timing when the output pulse signal from the switch control line PR becomes "High", all of the analog switches (ER1, . . . ) connected to the switch control line PR turn on simultaneously. This causes the signal potentials (Ra1, . . . Ra640) to be supplied, via the analog switches in the "on" state, to the corresponding data signal lines (SR1, . . . , SR640), respectively.

Subsequently, at the timing when an output pulse signal from the switch control line PG becomes "High", all of the switch circuits (JG 1, . . . ) connected to the switch control line PG turn on simultaneously, and the input signals (G1, . . . ) are inputted to the corresponding DACs (1, . . . ) via the corresponding inter-signal shared wires (CL1, . . . ), respectively. This converts the input signals (G1, . . . , G640) into analog signal potentials (Ga1, . . . , Ga640), respectively. Note that the switch control line PG is also connected to the corresponding analog switch. Therefore, at the timing when the output pulse from the switch control line PG becomes "High", all of the analog switches (EG1, . . . ) connected to the switch control line PG turn on simultaneously. This causes the signal potentials (Ga1, . . . Ga640) to be supplied, via the analog switches in the "on" state, to the corresponding data signal lines (SG1, . . . , SG640), respectively.

Subsequently, at the timing when an output pulse signal from the switch control line PB becomes "High", all of the switch circuits (JB1, . . . ) connected to the switch control line PB turn on simultaneously, and the input signals (B1, . . . ) are inputted to the corresponding DACs (1, . . . ), respectively. This converts the input signals (B1, . . . , B640) into analog signal potentials (Ba1, . . . , Ba640), respectively. Note that the switch control line PB is also connected to the corresponding analog switch. Therefore, at the timing when the output pulse from the switch control line PB becomes "High", all of the analog switches (EB1, . . . ) connected to the switch control line PB turn on simultaneously. This causes the signal potentials (Ba1, . . . Ba640) to be supplied, via the analog switches in the "on" state, to the corresponding data signal lines (SB1, . . . , SB640), respectively.

Figure 4:
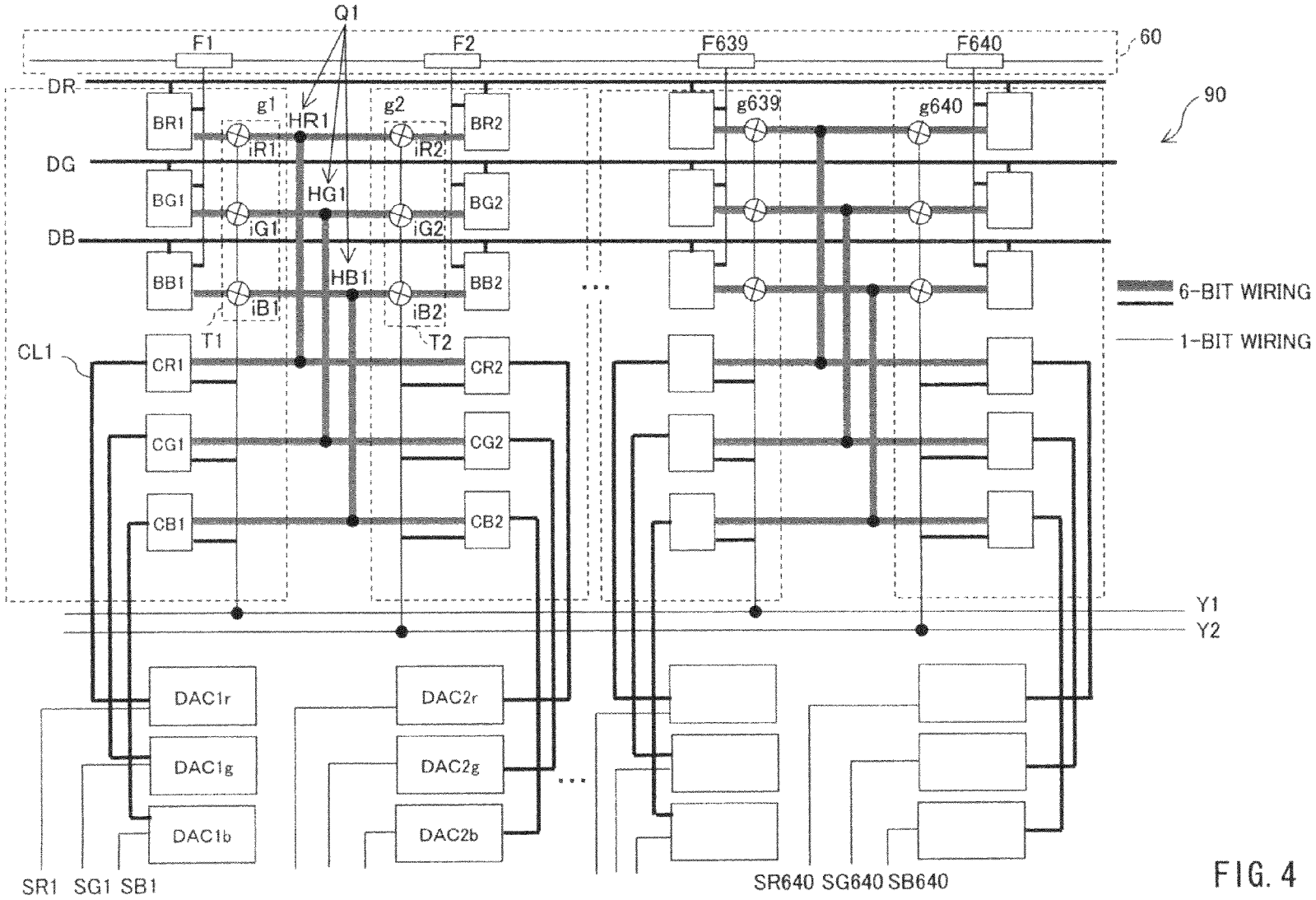
FIG. 4 is a circuit diagram illustrating a variation of the digital driver illustrated in FIG. 1.

Note that the digital driver 90 may be arranged as illustrated in FIG. 4. That is, the digital driver 90 illustrated in FIG. 4 is realized by providing, with the arrangement illustrated in FIG. 1, (i) three DACs for each of the signal processing blocks and (ii) none of the selection switch block K, the time division switch block W, or the three switch control lines PR, PG, and PB. The other parts in the arrangement in FIG. 4 are the same as these in the arrangement in FIG. 1.

In the arrangement illustrated in FIG. 4, each of the signal processing blocks includes one flip flop F, one circuit block g, and three DACs. Further, each of the signal processing blocks corresponds to three data signal lines SR, SG, and SB in a display section.

The circuit block g includes: three former latch blocks BR, BG, and BB lined up in the column direction; three latter latch blocks CR, CG, and CB lined up in the column direction; and one transmission switch block T.

Each of the latter latch blocks is connected to one corresponding data signal line via one corresponding DAC. For example, a latter latch block CR1 is connected to a data signal line SR1 via a DAC 1*r*, a latter latch block CG1 is connected to a data signal line SG1 via a DAC 1*g*, and a latter latch block CB1 is connected to a data signal line SB1 via a DAC 1*b*.

As illustrated in FIGS. 1 to 4, two circuit blocks (e.g., g1 and g2) adjacent to each other transmit a signal via a single inter-block shared wire Q in the time division manner. This reduces the number of wires to be used in the driver. In addition, the latter latch blocks (CR, CG, and CB) transmit a signal to the DAC via a single inter-signal shared wire CL in the time division manner. This reduces the number of wires to be used between the latter latch blocks and the DAC. This makes it possible to reduce the size of a digital driver. Especially in a case where a digital driver is formed on a liquid crystal panel monolithically, a decrease in the number of wires largely contributes to reduction of the size of a driver.

Figure 5:
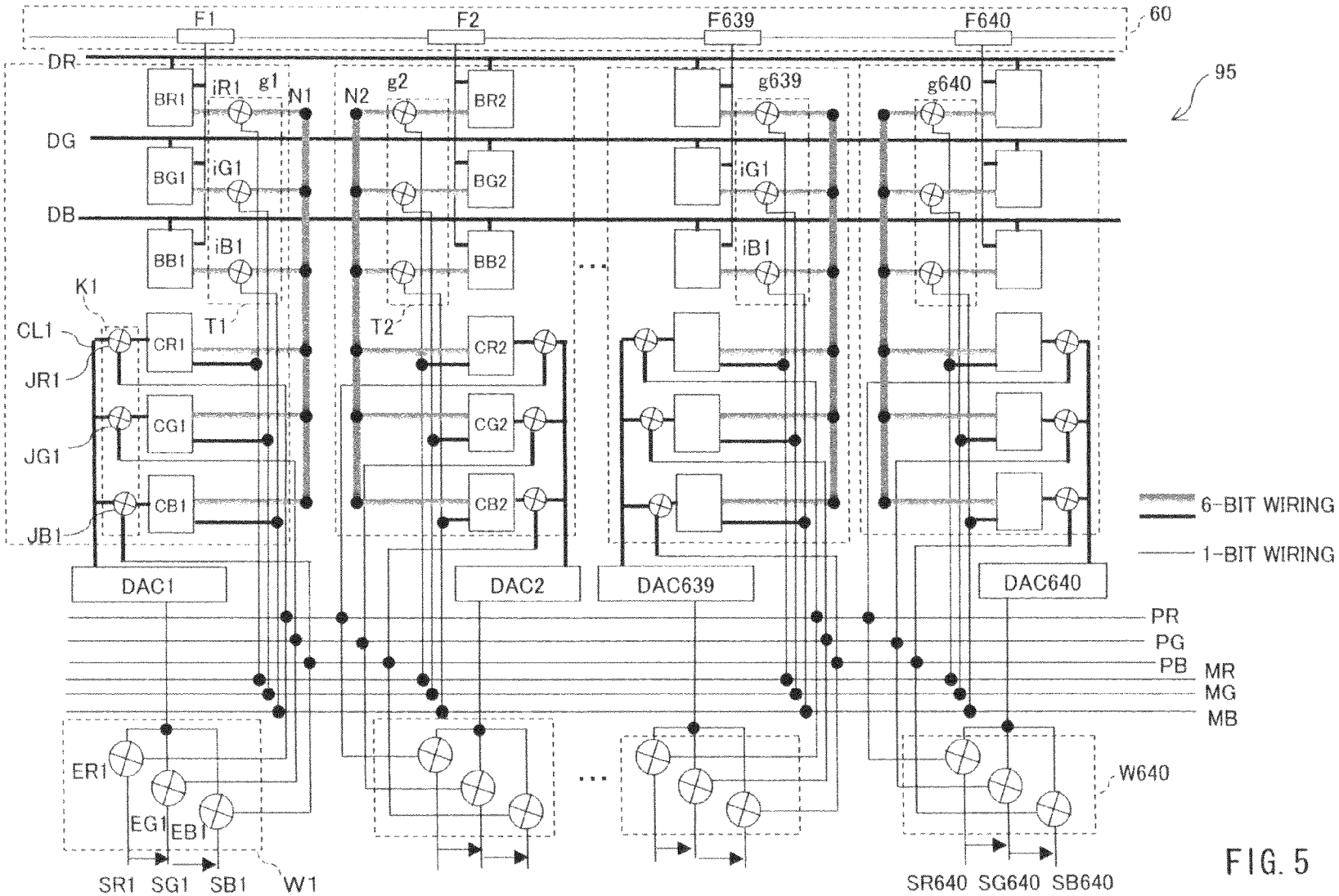
FIG. 5 is a circuit diagram illustrating another arrangement of the digital driver according to the present invention.
Figure 6:
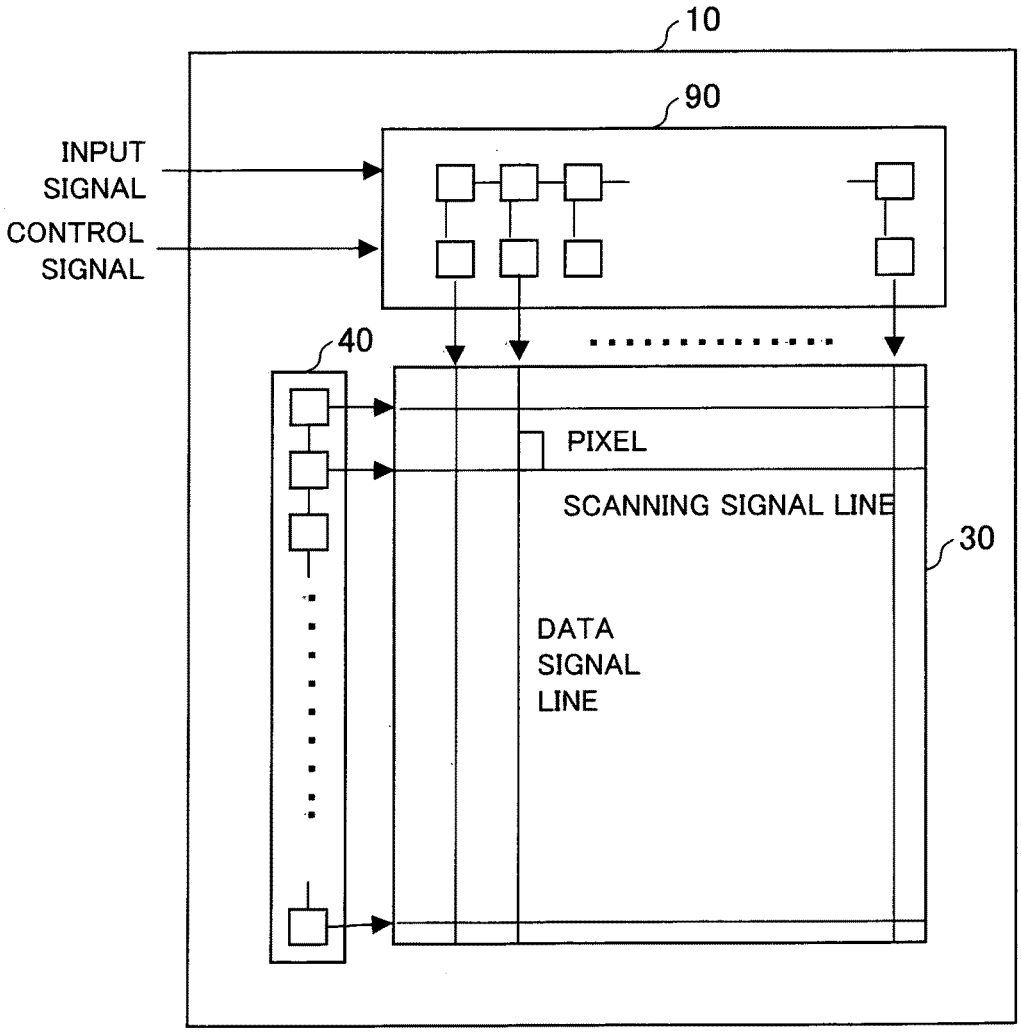
FIG. 6 is a schematic view illustrating the arrangement of a liquid crystal display device according to the present invention.

A digital driver of the present invention may be arranged as illustrated in FIG. 5. As illustrated in FIG. 5, a digital driver 95 includes: a plurality of signal processing blocks (not illustrated); three input signal lines DR, DG, and DB; three switch control lines PR, PG, and PB; and three (which is equal to the number of video signals) transmission switch lines (control signal lines) MR, MG, and MB.

Each of the signal processing blocks includes: one flip flop F (in a shift register); one circuit block g; one DAC; and one time division switch block W. Further, each of the signal processing blocks corresponds to three data signal lines SR, SG, and SB. The time division switch block W includes three analog switches ER, EG, and EB.

The circuit block g includes: a former circuit including three former latch blocks (former signal circuits) BR, BG, and BB lined up in the column direction; a latter circuit including three latter latch blocks (latter signal circuits) CR, CG, and CB lined up in the column direction; one transmission switch block T; an intra-block shared wire N; one selection switch block K; and one inter-signal shared wire (6 bits) CL.

In the digital driver 95, a plurality of circuit blocks are lined up in the row direction. The transmission switch block T includes three switch circuits iR, iG, and iB. The switch circuit iR contains 6 switching elements corresponding to HR; the switch circuit iG contains 6 switching elements corresponding to HG; and the switch circuit iB contains 6 switching elements corresponding to HB. (The 6 switching elements represent 6 bits.) That is, the transmission switch block T includes 18 switching elements for representing 18 bits. The selection switch block K includes three switch circuits JR, JG, and JB. The selection switch circuit JR contains 6 switching elements corresponding to the latter latch block CR; the selection switch circuit JG contains 6 switching elements corresponding to the latter latch block CG; and the selection switch circuit JB contains 6 switching elements corresponding to the latter latch block CB. (The 6 switching elements represent 6 bits.) That is, the selection switch block K includes 18 switching elements for representing 18 bits.

For example, the first signal processing block includes a flip flop F1, a circuit block g1, a DAC 1, and a time division switch block W1. Further, the first signal processing block corresponds to three data signal lines SR1, SG1, and SB1. The time division switch block W1 includes three analog switches ER1, EG1, and EB1. The circuit block g1 includes: three former latch blocks BR1, BG1, and BB1; three latter latch blocks CR1, CG1, and CB1; an intra-block shared wire N1; a transmission switch block T1; a selection switch block K1; and an inter-signal shared wire CL1. The transmission switch block T1 includes three switch circuits iR1, iG1, and iB1, and the selection switch block K1 includes three switch circuits JR1, JG1, and JB1.

As illustrated in FIG. 5, each of the former latch blocks is connected to a corresponding flip flop and to a corresponding input signal line. Further, each of the former latch blocks is connected to a corresponding latter latch block, via a corresponding switch circuit in a transmission switch block and an intra-block shared wire (6 bits). Also, each of the latter latch blocks is connected to a DAC, via a corresponding switch circuit in a selection switch block and an inter-signal shared wire (6 bits), and is connected to a corresponding transmission switch line. The transmission switch line is connected to the switch circuit in the transmission switch block.

For example, the former latch block BR1 is connected to the flip flop F1 and the input signal line DR, and is connected to the latter latch block CR1 via the switch circuit iR1 and the intra-block shared wire N1 (6 bits). The latter latch block CR1 is connected to the DAC 1 via the switch circuit JR1 and the inter-signal shared wire CL1 (6 bits), and is connected to the transmission switch line MR. The transmission switch line MR is connected to the switch circuit iR1 (in the transmission switch block T1).

As described above, the latter latch block CR is connected to the transmission switch line MR, the latter latch block CG is connected to the transmission switch line MG, and the latter latch block CB is connected to the transmission switch line MB. Further, the switch circuit iR in the transmission switch block is connected to the transmission switch line MR, the switch circuit iG is connected to the transmission switch line MG, and the switch circuit iB is connected to the transmission switch line MB.

With this arrangement, when the transmission switch line MR is activated, the switch circuit iR in the transmission switch block turns on. Then, a latch pulse signal is inputted to the latter latch block CR, and a signal that has been latched by the latch block BR is outputted from the latter latch block CR via the intra-block shared wire N. Similarly, when the transmission switch line MG is activated, the switch circuit iG in the transmission switch block turns on. Then, a latch pulse signal is inputted to the latter latch block CG, and a signal that has been latched by the former latch block BG is outputted from the latter latch block CG via the intra-block shared wire N. Similarly, when the transmission switch line MB is activated, the switch circuit iB in the transmission switch block turns on. Then, a latch pulse signal is inputted to the latter latch block CB, and a signal that has been latched by the former latch block BB is outputted from the latter latch block CB via the intra-block shared wire N.

Further, the three switch circuits included in each of the selection switch blocks are connected to corresponding switch control lines, respectively. That is, the switch circuit JR1 in the selection switch block K1 is connected to the switch control line PR, the switch circuit JG1 is connected to the switch control line PG, and the switch circuit JB1 is connected to the switch control line PB.

Each of the DACs is connected to the three data signal lines via a corresponding time division switch block. For example, the DAC 1 is connected to the data signal lines SR1, SG1 and SB1 via the time division switch block W1.

Further, the three analog switches included in each of the time division switch blocks are connected to corresponding switch control lines, respectively. Also, the three analog switches are connected to corresponding data signal lines, respectively. For example, the analog switch ER1 in the time division switch block W1 is connected to the switch control line PR and to the data signal line SR1, the analog switch EG1 is connected to the switch control line PG and to the data signal line SG1, and the analog switch EB1 is connected to the switch control line PB and to the data signal line SB1.

Also, for example, a red (R) signal is processed by the former latch block BR1 connected to the input signal line DR for red, the switch circuit iR, the intra-block shared wire N1, the latter latch block CR1, the switch circuit JR1, and the analog switch ER1, each of which corresponds to the former latch block BR1. A green (G) signal and a blue (B) signal are processed in a similar manner. The DAC 1 processes signals of three colors in a time division manner.

Figure 8:
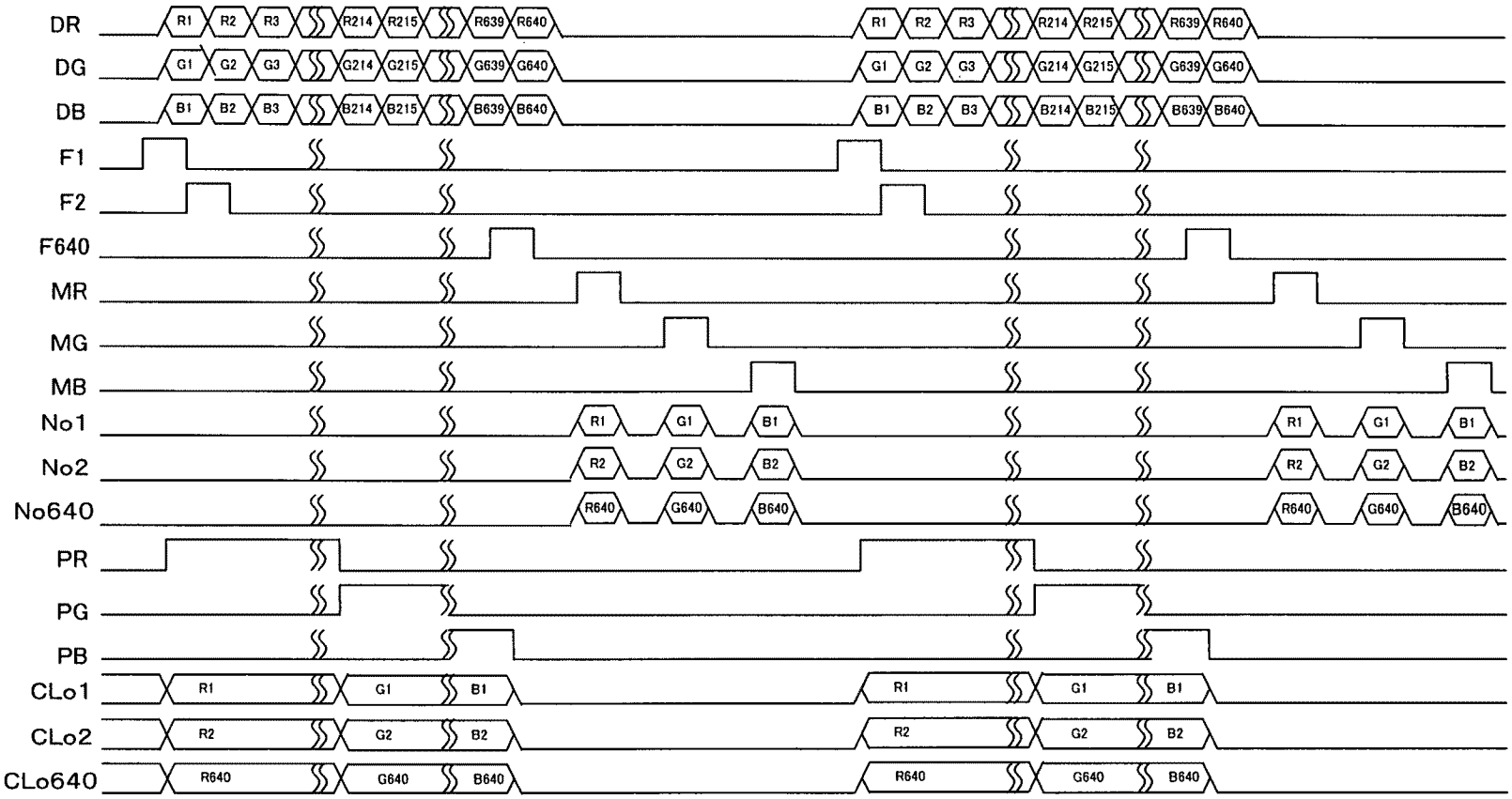
FIG. 8 is a timing chart illustrating operation of the digital driver illustrated in FIG. 5.
Figure 9:
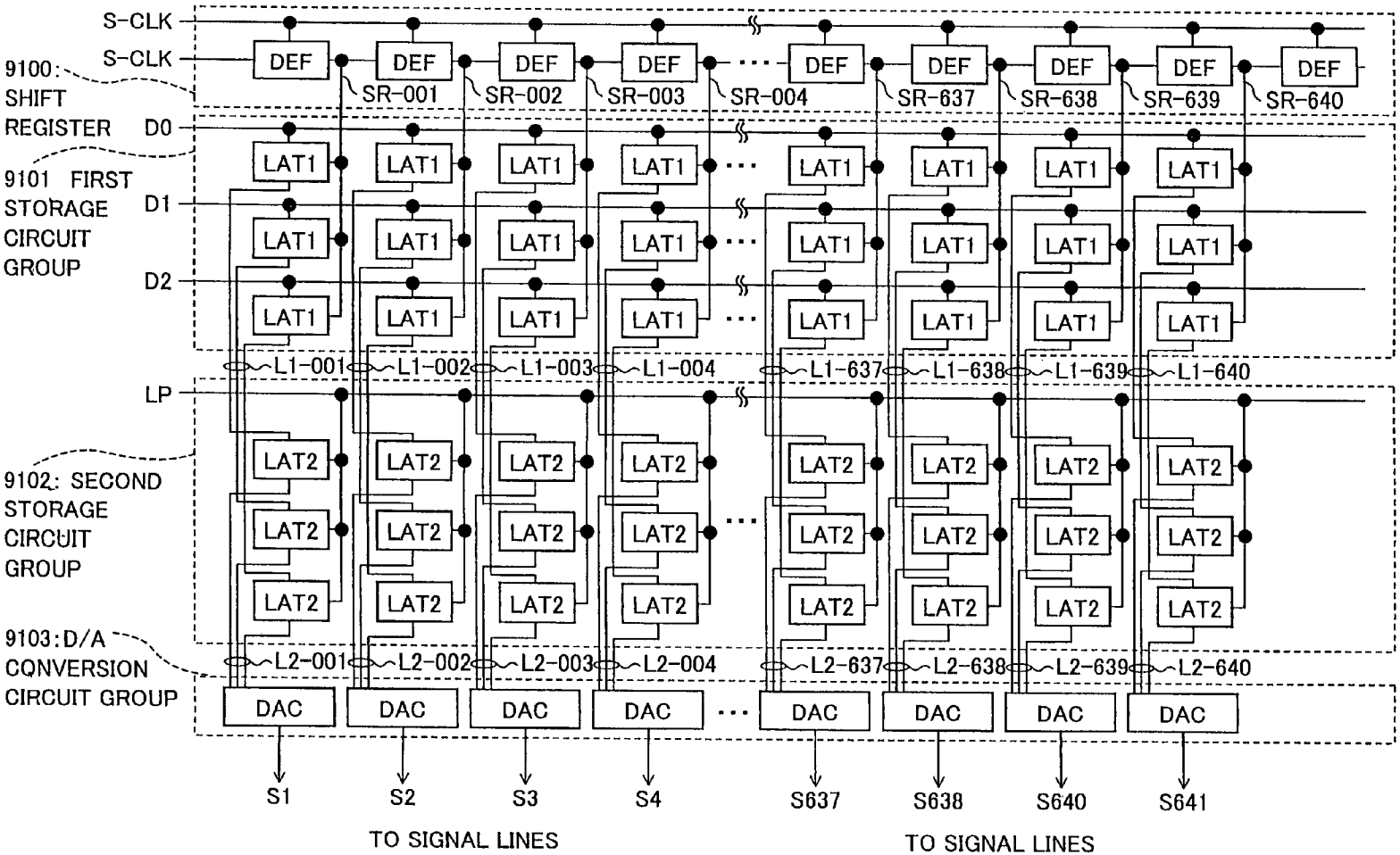
FIG. 9 Conventional Art
FIG. 9 is a circuit diagram illustrating the arrangement of a conventional digital driver.
Figure 10:
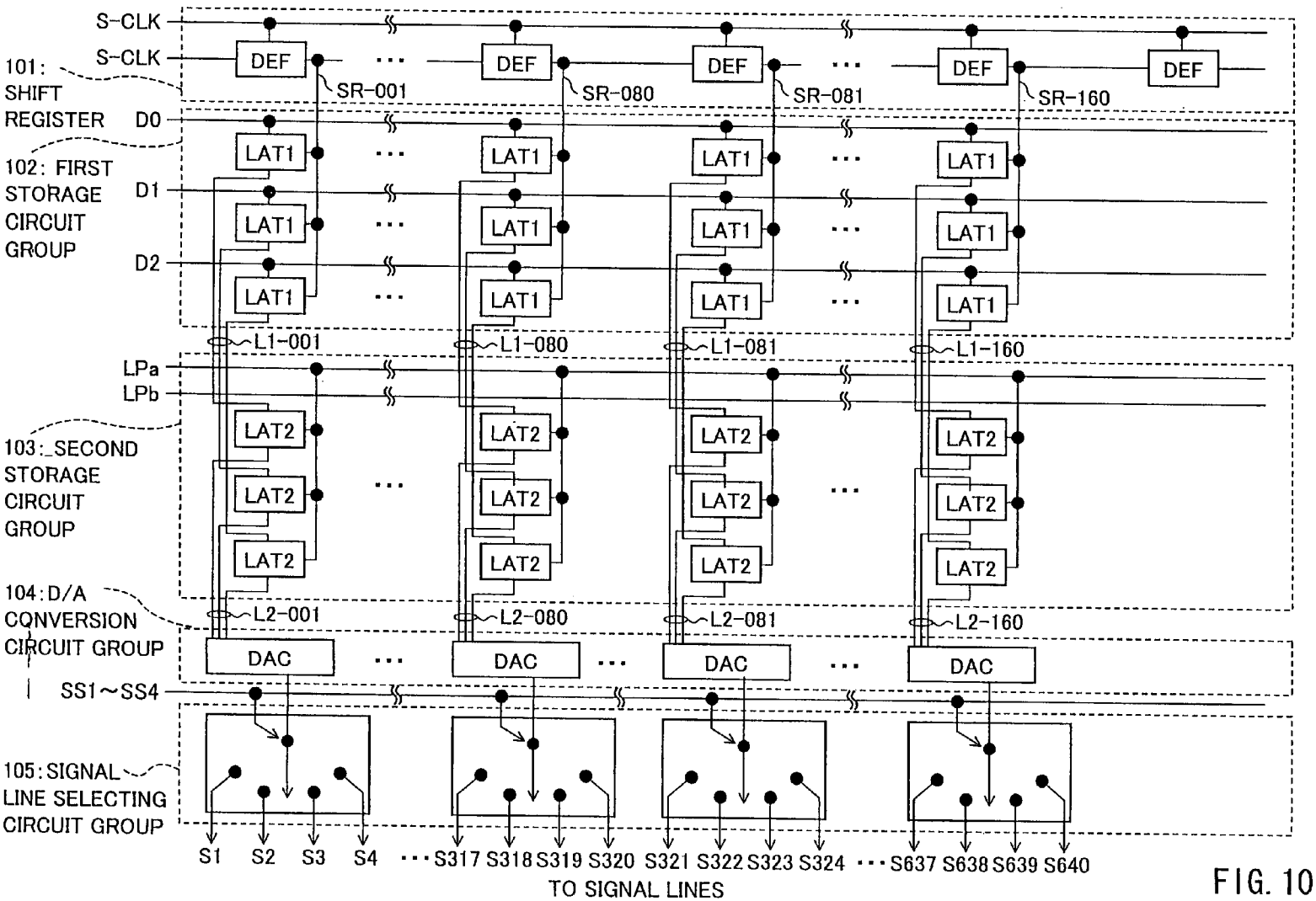
FIG. 10 Conventional Art
FIG. 10 is a circuit diagram illustrating the arrangement of a conventional digital driver.

The flow of signal processing in the digital driver 95 is illustrated in a timing chart illustrated in FIG. 8. In this timing chart, R1 to R640 are 6-bit input signal data corresponding to the data signal lines SR1 to SR640, respectively; G1 to G640 are 6-bit input signal data corresponding to the data signal lines SG1 to SG640, respectively; and B1 to B640 are 6-bit input signal data corresponding to the data signal lines SB1 to SB640, respectively. Also, No1 to No640 are signals of the intra-block shared wire; and CLo1 to CLo640 are signals of the inter-signal shared wire.

At the timing when the state of an output pulse signal from F1 changes from "Low" to "High" (active), the former latch block BR1 latches the input signal R1; the former latch block BG1 latches the input signal G1; and the former latch block BB1 latches the input signal B1. Similarly, when the states of output pulse signals from F2, . . . , F640 change from "Low" to "High" one after another, the input signals (R2, G2, and B2), . . . , (R640, G640, and B640) are latched accordingly.

After the input signals (R1, G1, and B1) . . . (R640, G640, and B640) are all latched, an output pulse signal from the transmission switch line MR becomes "High". This turns on all of the switch circuits iR connected to MR. Then, all of the input signals (R1 to R640) which have been latched by the former latch block BR are outputted to the latter latch block CR via the intra-block shared wire N. Subsequently, an output pulse signal from the transmission switch line MG becomes "High". This turns on all of the switch circuits iG connected to MG. Then, all of the input signals (G1 to G640) which have been latched by the former latch block GR are outputted to the latter latch block CG via the intra-block shared wire N. Subsequently, an output pulse signal from the transmission switch line MB becomes "High". This turns on all of the switch circuits iB connected to MB. Then, all of the input signals (G1 to G640) which have been latched by the former latch block BG are outputted to the latter latch block CB via the intra-block shared wire N.

Subsequently, at the timing when the state of an output pulse signal from the switch control line PR becomes "High", all of the switch circuits (JR1, . . . ) connected to the switch control line PR turn on simultaneously, and the input signals (R1, . . . ) are inputted to the DACs (1, . . . ) via the corresponding inter-signal shared wires (CL1, . . . ), respectively. This converts the input signals (R1, . . . , R640) into analog signal potentials (Ra1, . . . , Ra640), respectively. Note that the switch control line PR is also connected to the corresponding analog switch. Therefore, at the timing when the output pulse signal from the switch control line PR becomes "High", all of the analog switches (ER1, . . . ) connected to the switch control line PR turn on simultaneously. This causes the signal potentials (Ra1, . . . Ra640) to be supplied, via the analog switches in the "on" state, to the corresponding data signal lines (SR1, SR640), respectively.

Subsequently, at the timing when an output pulse signal from the switch control line PG becomes "High", all of the switch circuits (JG1, . . . ) connected to the switch control line PG turn on simultaneously, and the input signals (G1, . . . ) are inputted to the DACs (1, . . . ) via the corresponding inter-signal shared wires (CL1, . . . ). This converts the input signals (G1, . . . , G640) into analog signal potentials (Ga1, . . . , Ga640), respectively. Note that the switch control line PG is also connected to the corresponding analog switch. Therefore, at the timing when the output pulse signal from the switch control line PG becomes "High", all of the analog switches (EG1, . . . ) connected to the switch control line PG turn on simultaneously. This causes the signal potentials (Ga1, . . . Ga640) to be supplied, via the analog switches in the "on" state, to the corresponding data signal lines (SG1, . . . , SG640), respectively.

Subsequently, at the timing when an output pulse signal from the switch control line PB becomes "High", all of the switch circuits (JB1, . . . ) connected to the switch control line PB turn on simultaneously, and the input signals (B1, . . . ) are inputted to the corresponding DACs (1, . . . ), respectively. This converts the input signals (B1, . . . , B640) into analog signal potentials (Ba1, . . . , Ba640), respectively. Note that the switch control line PB is also connected to the corresponding analog switch. Therefore, at the timing when the output pulse signal from the switch control line PB becomes "High", all of the analog switches (EB1, . . . ) connected to the switch control line PB turn on simultaneously. This causes the signal potentials (Ba1, . . . Ba640) to be supplied, via the analog switches in the "on" state, to the corresponding data signal lines (SB1, . . . , SB640), respectively.

Thus, former latch blocks transmit a signal to corresponding latter latch blocks (BR→CR, BG→CG, BB→CB), respectively, via a single intra-block shared wire N in a time division manner. This makes it possible to reduce the number of wires to be used. In addition, the latter latch blocks (CR, CG, and CB) transmit a signal to a DAC via a single inter-signal shared wire CL in the time division manner. This makes it possible to reduce the number of wires to be used between latter latch blocks and a DAC. This makes it possible to reduce the size of a digital driver. Especially in a case where a digital driver is formed on a liquid crystal panel monolithically, the decrease in the number of wires largely contributes to the reduction of the size.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

Industrial Applicability

A display panel drive circuit of the present invention is useful for a source driver (especially for a digital driver) which is used in devices such as a liquid crystal display device.

The invention claimed is:

1. A display panel drive circuit, comprising:

a plurality of circuit blocks each of which includes a former circuit and a latter circuit by which the former circuit is followed, and in each of the plurality of circuit blocks a signal is transmitted from the former circuit to the latter circuit, the signal including a plurality of video signals, the former circuit including former signal circuits corresponding to the plurality of video signals, respectively, the latter circuit including latter signal circuits corresponding to the plurality of video signals, respectively, each of the former signal circuits including first latch circuits whose number is equal to a number of bits of a corresponding one of the plurality of video signals, each of the latter signal circuits including second latch circuits whose number is equal to the number of bits of a corresponding one of the plurality of video signals;

inter-block shared wires each of which allows respective two of the circuit blocks adjacent to each other to be connected to each other, a signal transmission from the former circuit to the latter circuit in one of the two circuit blocks and a signal transmission from the former circuit to the latter circuit in the other of the two circuit blocks being carried out in a time division manner, via a corresponding one of the inter-block shared wires, each of the inter-block shared wires including shared wires for the plurality of video signals, the plurality of video signals being inputted to the corresponding former signal circuits, and being transmitted to the corresponding latter signal circuits via the corresponding discriminatingly-shared wires, respectively, each of the discriminatingly-shared wires including wires whose number is equal to the number of bits of a corresponding one of the plurality of video signals; and switch circuits provided between the former signal circuits and the discriminatingly-shared wires, respectively, the switch circuits, provided between the former signal circuits belonging to odd-numbered ones of the plurality of circuit blocks and the discriminatingly-shared wires, respectively, being connected to a first control signal line, and the switch circuits, provided between the former signal circuits belonging to even-numbered ones of the plurality of circuit blocks and the discriminatingly-shared wires, respectively, being connected to a second control signal line.

2. The display panel drive circuit as set forth in claim 1, further comprising:

a signal passing circuit which is provided for each of the plurality of circuit blocks; and an inter-signal shared wire which is provided for each of the plurality of circuit blocks, and is connectable to all of the latter signal circuits belonging to said each of the plurality of circuit blocks, the signal from each of the latter signal circuits being transmitted to the signal passing circuit in the time division manner, via the inter-signal shared wire.

3. The display panel drive circuit as set forth in claim 2, wherein:

the signal passing circuit is a digital-analog converter circuit.

4. The display panel drive circuit as set forth in claim 1, wherein:

latch pulse signals, to be supplied to the second latch circuits in the latter signal circuits, are supplied, respectively, via a wire which is not any of the discriminatingly-shared wires.

5. The display panel drive circuit as set forth in claim 4, wherein:

the latch pulse signals to be supplied to the second latch circuits in the latter signal circuits belonging to the odd-numbered ones of the plurality of circuit blocks are supplied, respectively, via the first control signal line; and the latch pulse signals to be supplied to the second latch circuits in the latter signal circuits belonging to the even-numbered ones of the plurality of circuit blocks are supplied, respectively, via the second control signal line.

6. A display device, comprising:

a display panel; and a display panel drive circuit as set forth in claim 1.

7. The display device as set forth in claim 6, wherein:

the display panel and the display panel drive circuit are formed monolithically.

8. A display panel drive circuit, comprising:

a plurality of circuit blocks each of which includes a plurality of former signal circuits and latter signal circuits corresponding to the former signal circuits, respectively, and in each of the plurality of circuit blocks a signal is transmitted from the former signal circuits to corresponding ones of the latter signal circuits, respectively, the signal including a plurality of video signals, the former signal circuits being provided so as to correspond to the plurality of video signals, respectively, the latter signal circuits being provided so as to correspond to the plurality of video signals, respectively, each of the former signal circuits including first latch circuits whose number is equal to a number of bits of a corresponding one of the video signals, each of the latter signal circuits including second latch circuits whose number is equal to the number of bits of a corresponding one of the plurality of video signals;

an intra-block shared wire which is provided for each of the plurality of circuit blocks, and is connectable to all of the former signal circuits belonging to said each of the plurality of circuit blocks, signal transmissions from the plurality of former signal circuits to respective latter signal circuits being carried out in a time division manner, via the intra-block shared wire, the video signals being inputted to the corresponding former signal circuits, and being transmitted to the corresponding latter signal circuits, respectively, via the intra-block shared wire, the intra-block shared wire including wires whose number is equal to the number of bits of a corresponding one of the plurality of video signals; and switch circuits provided between the intra-block shared wire and the former signal circuits, respectively.

9. The display panel drive circuit as set forth in claim 8, wherein:

latch pulse signals, to be supplied to the second latch circuits in the latter signal circuits, are supplied, respectively, via a wire which is not the intra-block shared wire.

10. The display panel drive circuit as set forth in claim 9, further comprising:

control signal lines whose number is equal to the number of the plurality of video signals, wherein a single control signal line is used for supplying control signals to the switch circuits of the former signal circuits and the latch pulse signals to the second latch circuits in the latter signal circuits corresponding to the former signal circuits, respectively.

* * * * *